US005682692A

United States Patent [19]

Huang

[11] Patent Number: 5,682,692

[45] Date of Patent: Nov. 4, 1997

[54] STRUCTURE OF A MINIATURE ANIMATED DISPLAY

[76] Inventor: Ming Yu Huang, No. 9, Alley 60, Lane 476, Sec. 1, Kwangfu Road, Hsinchu City, Taiwan

[21] Appl. No.: 626,782

[22] Filed: Apr. 2, 1996

[51] Int. Cl.[6] ..... G09F 19/00; A63H 33/26

[52] U.S. Cl. ..... 40/414; 40/411; 40/426; 446/135; 446/136; 446/139

[58] Field of Search ..... 40/411, 414, 415, 40/426; 446/135, 136, 139; 472/6, 29

[56] References Cited

U.S. PATENT DOCUMENTS

| | | | |
|---|---|---|---|
| 1,355,613 | 10/1920 | Maier | 40/411 X |
| 2,500,475 | 3/1950 | Staaf | 446/136 X |
| 2,622,366 | 12/1952 | Abplanalp | 446/139 |
| 2,651,140 | 9/1953 | Kovac | 446/135 |
| 2,874,513 | 2/1959 | Connell | 40/415 X |
| 2,979,861 | 4/1961 | Staaf | 446/136 |
| 3,045,393 | 7/1962 | Knott | 446/135 |
| 4,177,592 | 12/1979 | Ruck | 40/426 |
| 4,838,825 | 6/1989 | Hwang et al. | 40/426 X |
| 5,542,376 | 8/1996 | Udelle et al. | 446/136 X |

*Primary Examiner*—Anthony Knight
*Assistant Examiner*—Andrea Chop
*Attorney, Agent, or Firm*—Pro-Techtor International

[57] ABSTRACT

A miniature animated display that operates by driving a steel bar with a motor. The steel bar causes the animation motion by means of the swing base and the U-shaped pedestal installed on the hinged assembled end formed by the two ends of the elastic steel bar. The orientation of the U-shaped pedestal is adjusted according to the position of the inner surface of the sliding path so that the circular magnet thereon is affixed on the inner surface of the sliding path.

2 Claims, 3 Drawing Sheets

STRUCTURE OF A MINIATURE ANIMATED DISPLAY

BACKGROUND OF THE INVENTION

1. Field of the Invention

The present invention is related to an improved structure of a miniature animated display, and more particularly to an improved coupling structure including a coupling and bar so that the interruption of coupling is avoided completely. A synchronous coupling elastic steel bar is used on the coupling mechanism. Therefore, the relation between a sliding path and a sled is also improved, and the simulated scenery becomes more interesting and animated.

2. Description of the Prior Art

One of the recent trends of toys and decorative articles is to simulate and miniaturize dynamic scenery. The object is to create a new and interesting effect so as to stimulate the consumer.

The present invention is an improvement on U.S. Pat. No. 4,177,592, entitled "Miniature Animated Display". In the miniature animated display, the four edges of the die base plate are combined with the bottom plate by a curved metal strip. The ice layer is made of polyvinyl and is spaced apart from the bottom plate by a spacer. A trapezoidal plate is installed between the bottom plate and the ice layer. A cylindrical magnet penetrates each of the four edges of the trapezoidal plate. A hinged hole is installed on the third edge of the trapezoidal plate. The hinged hole is opposite the tubular rivet line hole installed on bottom plate. The radial connecting structure is hinged at the hinged point by a sliding plate. A slot channel is installed on the rear portion of the sliding plate and a fixing pin is used to limit the range thereof so that when the motor is rotated, it will be constrained by the vibrating connection body. Skating figures having circular magnets are driven by the cylindrical magnet which is also driven by the trapezoidal plate. The two magnets are separated by the ice layer. Thus the skating figures are moved along the ice layer according to the motion of the trapezoidal plate creating an animated scene.

There are some shortcomings in the coupling structure described above:

1. In the simulation of the scenery, the design of a sled on the device is deficient so that the simulated scenery lacks reality and is uninteresting.
2. The radial connecting structure and the vibrating connecting structure are separated in the longitudinal direction, but the trapezoidal plate is fixed in the orbital level only by a circular magnet. When the two connecting structures are joined together, interruption between the two connecting structures occurs so that the action presents a phenomenon of vibrating.

SUMMARY OF THE INVENTION

The main object of the present invention is to drive a steel bar simultaneously with the driving of the motor, by means of a swing base and a U-shaped pedestal installed on a hinged assembled end formed by the two ends of the elastic steel bar. The orientation of the U-shaped pedestal is adjusted according to the radius of the inner surface of a sliding path so that the circular magnet thereon is affixed on the inner surface of the sliding path.

BRIEF DESCRIPTION OF THE DRAWINGS

The present invention will become more clear in light of the disclosure of the present invention as made with reference to the accompanying drawings, wherein.

DESCRIPTION OF THE PREFERRED EMBODIMENT

Figure 2:
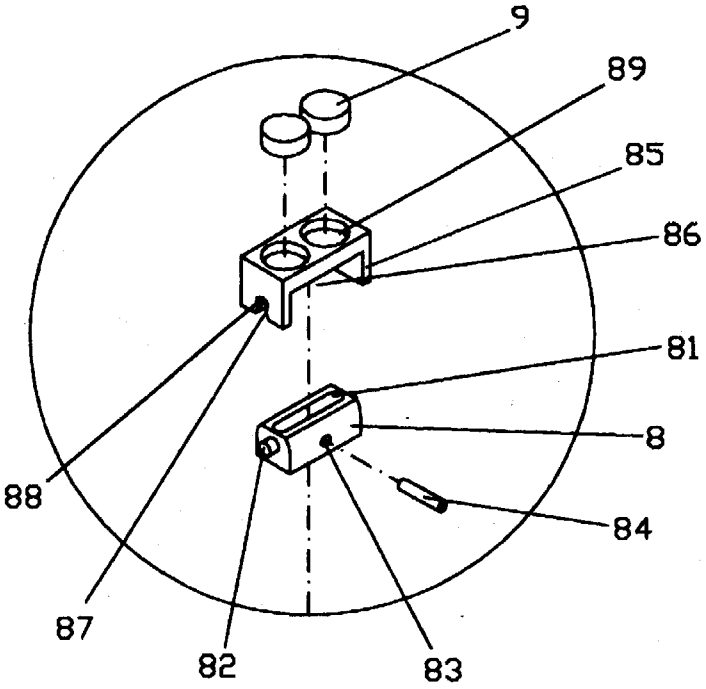
FIG. 2 is an enlarged view of the circled area in FIG. 1.
Figure 1:
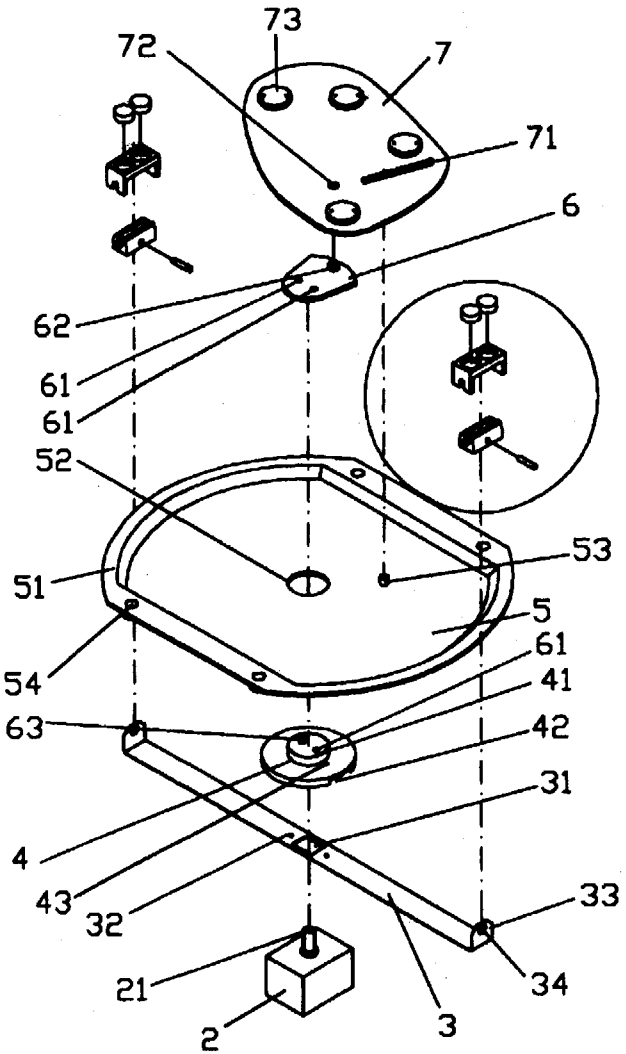
FIG. 1 shows an exploded view of the coupling construction of the present invention.

The present invention comprises a base 1, a bottom plate A, a sliding path 12 and a tunnel 13. Other simulated scenery forms a circular shape, and an area B is location on the inner surface of the sliding path 12.

A motor 2 is installed in the center of the base A. A hemispherical joint axle 21 is installed in the motor 2. The hemispherical joint axle 21 passes through the elastic steel bar 3, through opening 31, into the fixing portion of the fixing means 4. The upper portion of the fixing means 4 includes a circular convex block 41 which includes nose portion 63 and a hole 61.

The elastic steel bar 3 is positioned by the coupling groove 42 of the fixing means 4. The steel bar 3 is locked in place using screws to penetrate the tap holes 32, 43 of the steel bar 3 and the groove 42, respectively. The four holes 54 installed on the edge frame 51 of the substrate 5 are fixed under the nose portion 14 on the inner side of the sliding path 12.

A coupling plate 6 and an irregular plate 7 are located between an ice layer 11 and the substrate 5. A nose portion 62 installed on the coupling plate 6 is used to align with the hole 72 of the irregular plate 7. The slot 71 installed in the irregular plate 7 provides a constraint to a fixing column 53 of the substrate. Two holes 61' are installed on a lower end of the coupling plate 6. One hole 61' aligns with the nose portion 63 on the upper circular convex block 41 of the fixing means 4, through opening 52 in substrate 5. The other hole 61 is connected to the hole 61' on the convex block 41 of the fixing means 4 by a screw. When the motor 2 is rotated, circular magnets 73 on the irregular plate 7 revolve. Because the coupling plate 6 is driven to rotate through the fixing means 4 by the motor 2, and is matched with the slot 71 of the irregular plate 7 by the nose portion 62 of the coupling plate 6 and the fixing column 53 of the substrate 5, vibration of the device is prevented. Therefore, the skating figure is not knocked off the device.

Figure 3:
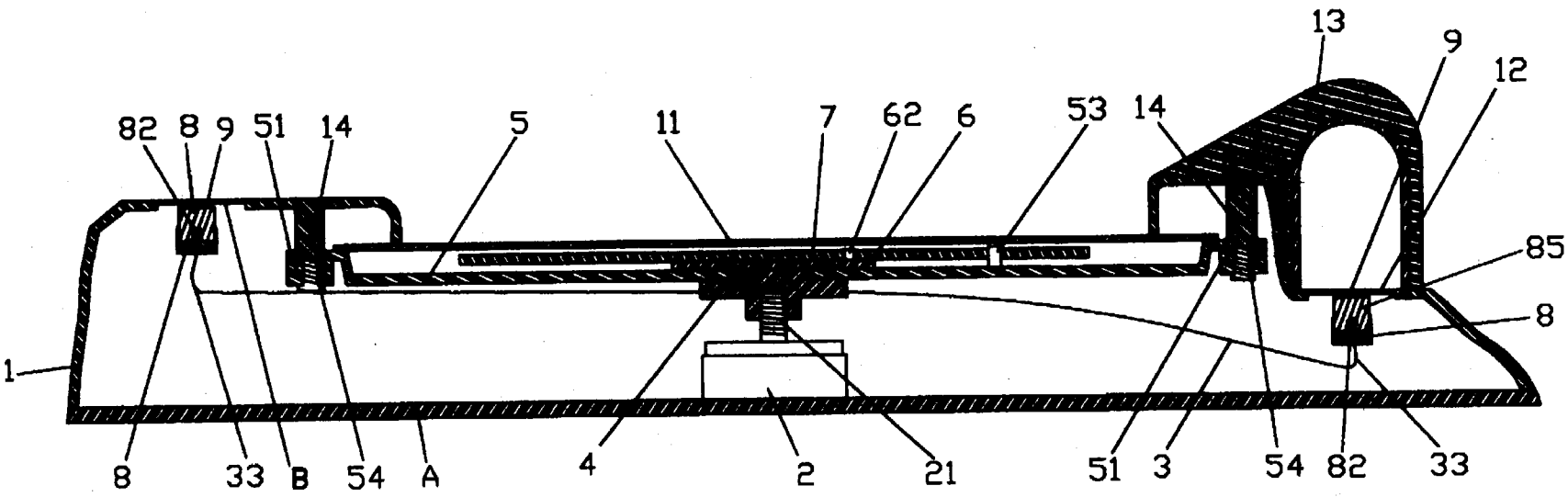
FIG. 3 is a cross-section view of the present invention.
Figure 4:
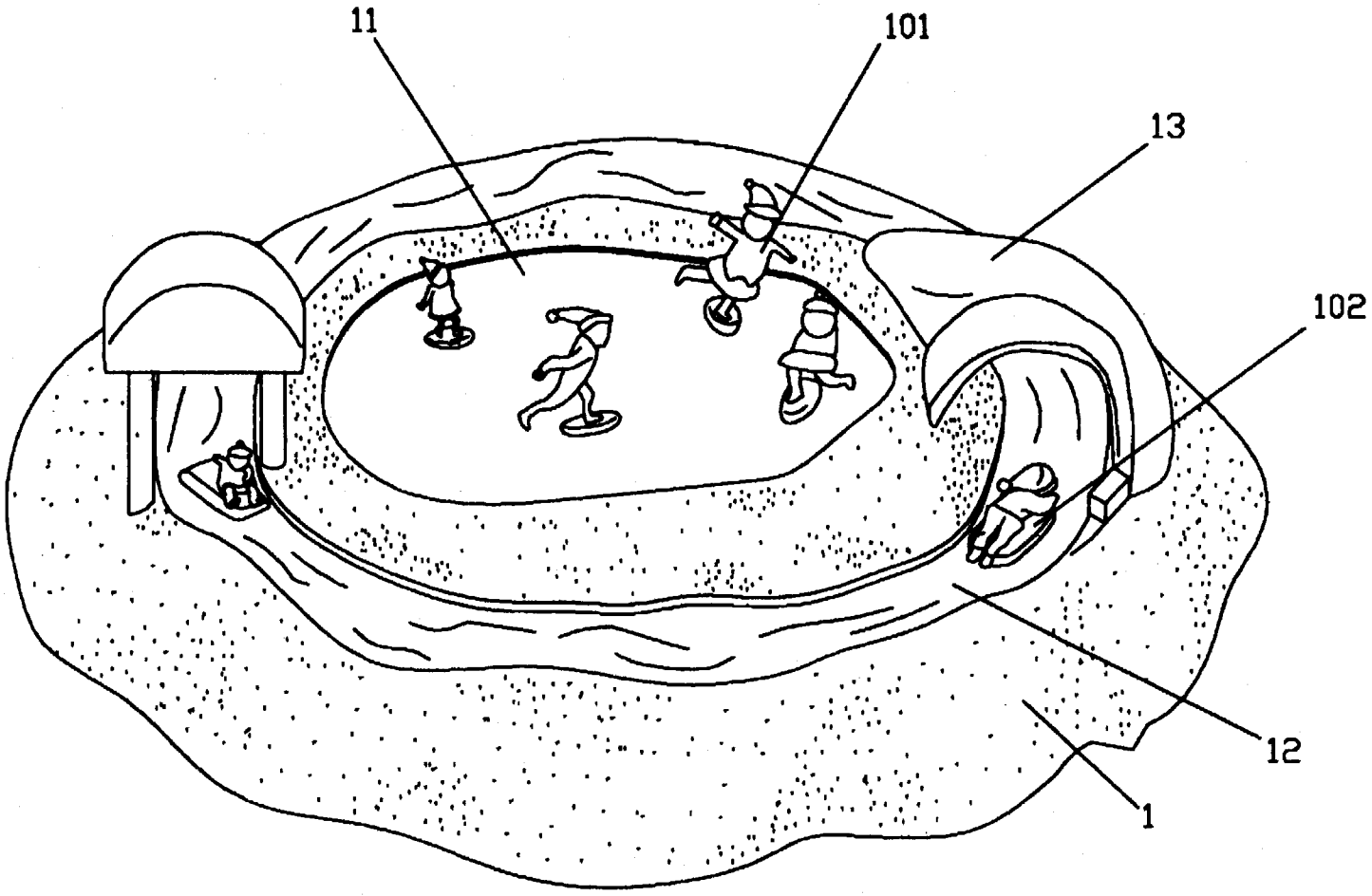
FIG. 4 is a perspective view of the present invention.

As shown in FIGS. 2 and 3, the elastic steel bar 3 is driven by the motor 2 so that ends 33 are deflected to an angle of between 75 degrees and 85 degrees. A hole 34 is installed on the end face.

The hinged assembled end 33 passes through an active groove 81 of a swing base 8 where it is pivotally affixed by a fixing pin 84, through opening 83. Thus the swing base 8 can swing forward and backward on the hinged assembled ends 33. A nose portion 82 is installed on the front end and the back end of the swing base 8. The nose portions 82 are received in notches 87 installed on the two sides on the lower portion 86 of U-shaped pedestal 85. Thus the nose portion 82 of the swing base 8 is pivotally assembled with hole 88 of the pedestal 85. Similarly, the U-shaped pedestal 85 rotates left and right in relation to the nose portion 82.

Two circular openings 89 are installed on the U-shaped pedestal 85 to receive magnets 9. When the motor 2 rotates, the circular magnet 9, and thus the circular magnet 73 installed on the irregular plate 7 and the U-shaped pedestal 85 slide on the inner surface of the ice layer 11 and the sliding path 12. Thus both the skating FIG. 101, and the sled 102 are driven to present a realistic scene.

By the design of the swing pedestal 8 and the U-shaped pedestal 85 installed on the two ends of the elastic steel bar 3, the circular magnet 9 is moved along the irregular curved surface. By the matching of the nose portion 62 of the coupling plate 62 and the slot 71 of the irregular plate 7, the desired effect is attained.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A miniature animated display comprising a base with a bottom plate and a sliding path and additional scenery in a circular shape;

a motor with a rotatable hemispherical joint axle installed within said base;

an elastic steel bar is positioned on said hemispherical joint axle by a coupling groove of a fixing means so that the elastic steel bar rotates with the hemispherical joint axle;

two ends of said elastic steel bar are bent upward, and are under tension;

a swing base is attached to each end of the steel bar, a nose portion is included on each end of each said swing base;

a U-shaped pedestal is attached to said nose portions of said swing base by a coupling opening and a hole;

a substrate which is fixed on an inner face of said sliding path;

a coupling plate positioned between an ice layer and said substrate, said coupling plate is driven by said hemispherical joint axle of said motor;

a nose portion of said coupling plate is received in a hole in an irregular plate, said irregular plate includes a slot that receives a fixing column of said substrate wherein;

said irregular plate and said elastic steel bar rotate in conjunction with rotation of said motor to drive circular magnets installed on said U-shaped pedestals and circular magnets installed on said irregular plate, so that figures attached to said magnets are moved on the ice layer and the sliding path by the magnetic force of the moving magnets.

2. The miniature animated display as claimed in claim 1, wherein;

the angle at which said ends of said elastic steel bar are bent relative to a inner portion of said steel bar is between 75 degrees and 85 degrees.

* * * * *